United States Patent [19]

Kelly

[11] Patent Number: 4,621,464

[45] Date of Patent: Nov. 11, 1986

[54] EDGING GLASS SHEETS WITH DIAMOND WHEELS

[75] Inventor: Joseph B. Kelly, Crestline, Ohio

[73] Assignee: PPG Industries, Inc., Pittsburgh, Pa.

[21] Appl. No.: 605,507

[22] Filed: Apr. 30, 1984

[51] Int. Cl.[4] ..... B24B 1/00

[52] U.S. Cl. ..... 51/283 E; 51/206 R

[58] Field of Search ..... 51/283 E, 206 R

[56] References Cited

U.S. PATENT DOCUMENTS

| | | | |
|---|---|---|---|
| 1,097,565 | 5/1914 | Straubel . | |
| 2,508,042 | 5/1950 | Rehnberg . | |
| 3,121,299 | 2/1964 | Fye . | |
| 3,177,624 | 4/1965 | Highberg . | |
| 3,177,628 | 4/1965 | Highberg . | |
| 3,233,369 | 2/1966 | Highberg . | |
| 3,243,922 | 4/1966 | Highberg . | |
| 3,383,807 | 5/1968 | Miller | 51/206 R |
| 3,468,583 | 9/1969 | Austin . | |
| 3,640,027 | 2/1972 | Weiss | 51/206 R |
| 3,664,819 | 5/1972 | Sioui et al. . | |
| 3,779,727 | 12/1973 | Sioui et al. . | |
| 3,868,232 | 2/1975 | Sioui et al. . | |
| 3,869,263 | 3/1975 | Greenspan . | |
| 3,898,772 | 8/1975 | Sawluk . | |
| 4,042,346 | 8/1977 | Sioui et al. . | |
| 4,157,897 | 6/1979 | Keat . | |
| 4,286,415 | 9/1981 | Loreto | 51/283 E |
| 4,334,895 | 6/1982 | Keat . | |
| 4,378,233 | 3/1983 | Carver . | |

*Primary Examiner*—Frederick R. Schmidt
*Assistant Examiner*—Joseph T. Zatarga
*Attorney, Agent, or Firm*—Andrew C. Siminerio; Edward I. Mates

[57] ABSTRACT

Edge grinding cut glass sheets by engaging the moving edge of a cut glass sheet with a rotating edge grinding wheel having blocky diamonds in a concentration not exceeding 20 embedded in a matrix.

3 Claims, No Drawings

EDGING GLASS SHEETS WITH DIAMOND WHEELS

BACKGROUND OF THE INVENTION

I. Field of the Invention

The present invention relates to the edging of glass sheets with diamond wheels, particularly the edging of glass sheets having contoured edge surfaces from major surface to major surface.

When glass sheets are fabricated to various outline shapes conforming to the outlines required for fabricated products such as windows for automobiles or other vehicles, they develop sharp edges as a result of the cutting operation. It is customary to provide glass sheets with a smooth edge by engaging a perimeter of the glass sheet having the raw cut edge with an edge grinding wheel that rotates while force is applied between the wheel and the edge of the glass in a radial direction outwardly from the center of rotation of the rotating grinding wheel and move the glass peripherally past the point of engagement so as to impart a smooth edge to the glass.

The smooth finish may be in the form of a seamed edge of moderate fineness or finish or a so-called satin finish which is a much finer finish. It is also important that a precise amount of glass be removed from each increment of the glass sheet periphery in order to ensure a proper outline shape for the glass. The shape of the glass sheet edge in the direction of its thickness is also important.

II. Technical Background and Description of Patents of Interest

It is extremely important that the edge of a cut glass sheet be smooth in order to avoid edges having sharp corners that tend to cause injury to personnel who have to handle the glass sheets and also to the people who operate installations containing the cut glass sheets. Accordingly, when glass sheets are ground along their edges, a curved edge surface which may be round or of other configuration avoiding sharp edges is produced.

It is customary to provide a glass sheet with a smooth edge by rotating a cut glass sheet so that its edge moves past an edge grinding station. There the glass edge is ground to a surface smoothness by engaging a perimeter of the cut glass sheet as each increment passes the grinding station with an edge grinding wheel that usually comprises diamond grit or other abrasive material embedded in a matrix. The edge grinding wheel rotates while force is applied between the wheel and the edge of the glass sheet in a radial direction from the center of rotation of the rotating glass sheet so as to impart a smooth edge along the glass periphery. The edge that develops in the glass sheet periphery may be contoured from major surface to major surface to a design shape in the direction of the glass sheet thickness depending upon the peripheral shape of the thickness dimension of the edge grinding wheel that is applied against the edge of the rotating glass sheet under pressure while the edge grinding wheel rotates. A cam conforming to the outline shape desired for the glass sheet controls inward and outward movement of the edge grinding wheel relative to the center of rotation of the glass sheet as the glass edge passes the edge grinding station.

In a particular commercial operation, cut glass sheets having essentially straight edges from major surface to major surface are ground to provide convexly curved outer edges around the entire periphery of the sheet.

The edging wheel is provided with a concavely shaped outer edge that engages the glass sheet edge and the rate of movement of the glass sheet past the rotating edging wheel is so adjusted that the force applied by the rotating edging wheel against the glass edge in the direction of the radius of the rotation of the glass sheet is sufficient to remove enough excess glass to provide the sheet with the requisite outline. If the force applied between the diamond wheel and the glass is reduced at a particular rate of travel of the glass periphery past the rotating edging wheel, oversize glass sheets are produced. If the rate of travel of the glass sheet is reduced, the amount of glass stock removal from each increment of length of the glass periphery is increased. Furthermore, as time goes on, the sharpness of the wheel is modified as the diamonds in the outer surface of the wheel are broken into smaller fragments. Smaller size fragments cause a lessening of the rate of removal of the glass stock from the edge of the cut glass compared to the original size fragments.

A particular rate of glass travel past the rotating edge grinding wheel is desired to grind the edge of glass sheets at a desired minimum rate. A minimum amount of stock removal is needed in order to change the shape of the edge of the glass from a straight shape with sharp edges at each corner of each major surface with the edge surface to a rounded edge surface with rounded corners. Furthermore, in order to have a maximum stock removal, the maximum possible uniform pressure that can be applied using existing equipment should be applied against the glass edge by the rotating diamond wheel.

As time goes by, the diamonds in the outer surface of the wheel break into smaller fragments resulting in a slower rate of glass removal. This causes the outline of the glass sheets to be oversized if the rate of glass movement past the rotating edge grinding wheel is maintained. In addition, the peripheral edge of the edge grinding wheel, initially of uniform radius of curvature of concave configuration, develops into more of a U-shaped configuration. When the center of the thickness of the edge grinding wheel flattens to develop approximately 50 percent greater radius than the initial radius imparted to the edge of the edge grinding wheel, it becomes necessary to redress the wheel to provide it with a desired concave shape of uniform curvature. When oversize glass sheets that are larger than the largest size permitted by the customer tolerances are produced, it is necessary to stone the wheel. Stoning requires the removal of a uniform layer of the periphery of the wheel that is approximately equal to the typical particle size of the diamonds embedded within the wheel. The stoning operation exposes a fresh diamond embedded surface that results after the removal of the surface layer that has been depleted of diamonds. Thus, the fresh surface having adequate removal properties replaces the depleted surface having inadequate removal properties.

When glass sheets are edge ground from the sharp edges developed from cutting to the rounded edges developed from edge grinding, it is common to have the thickness of the edge grinding wheels aligned with the thickness of the glass sheet. Thus, the portion of the edge grinding wheel that engages the sharp corners of the glass and from which a relatively large degree of glass removal is required causes much greater wear on the portion of the edging wheel than in the central portion of the wheel that engages the central portion of the glass sheet thickness. Thus, the profile along the edge of the grinding wheel changes from a continuous radius curvature to one that has a relatively large radius of curvature in its central portion. It has generally been developed that the periphery of the edge grinding wheels are reground to the desired shape when the central 40 percent of the thickness of the glass develops a radius that approximates twice the original radius. Also, when glass sheets are removed from the edging station in an oversize condition, the operator knows that it is time to stone the glass so as to restore the exposed edge of the glass with diamonds that have not broken down into such small sizes that they are incapable of removing the amount of glass sheet edge required in the time that the perimeter of the glass sheet passes the rotating edge grinding wheel.

Every time an edge grinding wheel is stoned, the diameter of the wheel is reduced. This requires changing the position of the grinding wheel relative to a cam that controls the position of the edging wheel perimeter relative to different portions of the perimeter of the glass sheet that undergoes edge grinding as the diameter of the edge grinding wheel decreases due to wear so that its position must be adjusted.

The technique of stoning is usually accomplished in 10 or 15 seconds to restore the exposed edge of the grinding wheel to have a surface with the desired number of diamonds to provide the proper degree of abrasion. In the past, edge grinding wheels provided with natural diamonds of various sizes and shapes made it difficult, if not impossible, to get uniformity of glass edge removal. In order to provide more uniform control of the rate of wear of diamond wheels on the edge of the glass, synthetic diamonds have been used.

The best synthetic diamonds for edge grinding wheels available commercially prior to the present invention are the so-called MBG II variety supplied by General Electric. These diamonds have XYZ coordinates in an approximate ratio of 1 to 1 to 2. MBG II diamonds break into smaller diamond particles and the wheel has to be reshaped to its desired shape or contour very frequently, particularly when the diamond concentration is reduced. This causes the edge grinding wheel to be worn out relatively rapidly. The term concentration as discussed herein is based on a value of 100 for a concentration of 72 carats per cubic inch of matrix in which the diamonds are embedded and supported.

For a given overall pressure applied by a diamond wheel apparatus, the average pressure applied between each individual diamond and the glass sheet edge as the diamond wheel rotates in pressurized rotational engagement against the edge of the glass sheet increases as the diamond concentration decreases. The MBG II type of diamonds tends to break up due to the high unit pressure of each individual diamond tip against the edge of the glass when the diamond concentration is reduced.

When a new edge grinding wheel is prepared for operation, it must be abraded to expose the diamonds that are embedded in the matrix at the surface before the edge grinding wheel can be used efficiently. Frequently, during the campaign of an edge grinding wheel, the wheel is reshaped and stoned several times and the frequency of stoning required determines the life of the edge grinding wheel.

Blocky diamonds are less likely to wear than elongated diamonds of the MBG II variety. Blocky diamonds are essentially cubical in shape with sharp corners broken off or rounded off. However, to the best of my knowledge, blocky diamonds have not been incorporated in edge grinding wheels because of the assumption that the glass edges would chip and not develop the smooth finish required for fabricated products if they were ground with blocky diamonds.

U.S. Pat. No. 1,097,565 to Straubel discloses a glass surface grinding tool containing grains of diamond grit having a diameter of ½ millimeter to 1/15 millimeter dispersed so that the average distance between grains in a superficial layer of the tool is a high multiple of the average dianeter of the grains.

U.S. Pat. No. 2,508,042 to Rehnberg discloses a grinding wheel of metal into areas of which diamond grains are embedded. Preferably the grains are of a grit size 60 and finer.

U.S. Pat. No. 3,177,624 to Highberg uses diamond grinders to polish the major surfaces of plate glass. The diamond grinders have low diamond concentration of less than 20 carats per cubic inch of matrix (equivalent to less than a 14 concentration) in the first grinding wheel and increase in diamond concentration in successive grinding stages to develop a grinding wheel life of 2,600 or more cubic inches of glass removed per carat of diamond. The diamonds are approximately 50 to 60 grit size. Larger grit sizes on the order of 20 to 30 grit tend to cause excessive edge chipping and breakage of plate glass. This patent grinds the surface in spaced relation to the edges of the ribbon to avoid edge damage.

U.S. Pat. No. 3,177,628 to Highberg reports that using diamond wheels of lower diamond concentration in the latter stages of grinding rather than in the earlier stages gives improved results contrary to the teaching of the previous Highberg patent. The alleged reason for this inconsistency is the theory that there is an optimum pressure for each diamond particle decreasing with increase in grit size number which accompanies decrease in average particle size. This patent also reports that cubic boron nitride is a particularly hard abrasive, but does not mention blocky diamonds, which are essentially cubic.

U.S. Pat. No. 3,233,369 to Highberg discloses a different arrangement of glass grinding wheels using diamonds or cubic boron nitride as the grinding elements wherein the diamond concentration is low in the early stages, increased in the intermediate stages and, with a reduction in diamond particle size, of largest concentration in the late stages. This patent also is limited to the grinding of major surfaces of plate glass in spaced relation to the edge of the glass.

U.S. Pat. No. 3,243,922 to Highberg discloses surfacing the major surfaces of glass using a rotatable grinding tool and a coolant. This patent shows that each grit size provides a characteristic wheel life in cubic inches of glass removed per carat of different concentrations. At 100–200 mesh grit size, a preferred range of diamond concentration is 15 to 60 carats per cubic inch (equivalent to a concentration of 11 to 42) and for 200 to 230 mesh grit size, a preferred diamond concentration range is 5 to 50 carats per cubic inch (equivalent to a concentration of 3.6 to 36. However, this patent does not mention the use of blocky diamonds of essentially cubic configuration.

U.S. Pat. No. 3,468,583 to Austin discloses diamond milling cutters having axially spaced parallel ridges and grooves on and in which diamonds are arranged. Means is provided to flood the working surface to remove particles abraded from the surface to be worked.

U.S. Pat. No. 3,664,819 to Sioui et al. discloses metal coated diamond or cubic boron nitride abrasive tools that are bonded in an organic bond that incorporates graphite of fine particle size and silicon carbide. The abrasive grits occupy 7% to 40% of the tool especially adapted to dry grind metal carbides and tool steels.

U.S. Pat. No. 3,779,727 to Sioui et al. discloses further improvement in dry grinding of cemented tungsten carbide and other metals by providing grinding tools of metal coated diamond or cubic boron nitride in a concentration of 10% to 60%, preferably 30% to 50%, by volume of the total of bond and fillers of silver or copper and from 5% to 30%, preferably 10% to 20%, of a solid dry film lubricant.

U.S. Pat. No. 3,868,232 to Sioui et al. discloses grinding wheels containing molybdenum and molybdenum disulphide lubricant for grinding carbide.

U.S. Pat. No. 3,869,263 to Greenspan embeds particles of diamond or other abrasive material in a working surface having a plurality of interspaced rounded protuberances and depressions. When the protuberances wear, fresh abrasive particles from the lower regions of the sloping surfaces become exposed through the work.

U.S. Pat. No. 3,898,772 to Sawluk discloses a cutting tool having multiple cutting edges, each containing an homogenous mass of crystalline diamond particles or crystalline boron nitride particles produced synthetically and arranged in a concentration of 80% particles and the rest of the catalyst used to synthesize the diamond or boron nitride particles.

U.S. Pat. No. 4,042,346 to Sioui et al. discloses a diamond or cubic boron nitride grinding wheel of ring-like configuration adhered to a resinous core having high heat conductivity and free of lime, which is associated with cracking of the grinding wheel.

Despite the extensive information disclosed in the various patents enumerated, some of which is conflicting, the glass sheet edge grinding art still needed apparatus that lasted longer than the edge grinding wheels of the prior art, that required less frequent stoning and reshaping and provided cut glass edges with smoother surfaces of rounded configuration.

SUMMARY OF THE INVENTION

It has now been discovered that cut glass sheets may be provided with smooth rounded or beveled edges with a grinding wheel that requires less frequent stoning than grinding wheels provided with the best prior art material such as the MBG II diamonds. Such diamonds of the prior art are needle like in shape and in operating conditions such wheels broke into smaller diamond particles that required stoning approximately every 20 minutes.

The method of edging a glass sheet according to the present invention involves the use of a diamond wheel that contains diamonds of a blocky shape and a concentration that does not exceed approximately 20, equivalent to 14 carats of diamond per cubic inch of matrix. Such diamonds do not require stoning until after 8 hours of use. The life of the edge grinding wheel used to perform the novel method of the present invention is more than twice as long as the previous edge grinding wheels using the more needle-like MBG II diamonds. This improvement in wheel life occurred even though the force applied by the rotating edge grinding wheel to the glass edge and the speed of glass edge movement past the grinding wheel did not change.

A description of the preferred embodiment that follows should advise the reader of further benefits that result from the use of the present invention.

DESCRIPTION OF THE PREFERRED EMBODIMENT

A preferred embodiment of the present invention used with a so-called D-mesh wheel incorporating diamonds having a typical particle size of 3.5 mils (0.9 mm) comprises a glass sheet edging method wherein the diamond wheel is rotated at a speed of 2800 to 3600 rpm while the periphery of the glass sheet undergoing edging moves past an edging station at a speed of 1.5 to 3 inches (3.8 to 7.6 cm) per second depending on the complexity of the outline of the glass sheet. The edges of the glass sheets were ground using diamond wheels having diamonds of a blocky shape embedded in a matrix which may be of any metal or other well-known material used for embedding diamonds, and the concentration of the diamonds did not exceed approximately 20, which conforms to approximately 14 carats of diamonds per cubic inch of matrix.

Examples of blocky shaped diamonds are available from DeBeers under the Catalogue No. AD-100 and from Norton under Catalogue No. XL-1645. The latter diamonds are commonly used in diamond saws for sawing concrete.

Blocky diamonds have to be capable of passing through 120 mesh in order to develop a satisfactory seam edge, and diamonds capable of passing through 150 mesh are required to develop a satin finish. Diamonds of 20 concentration provided with a blocky shape that passed through a 100 grit screen were too coarse to provide a smooth enough edge to satisfy customer requirements.

The following data were developed under production conditions using different types of diamonds in edge grinding wheels that rotated against the edge of glass sheets of 6 mm thickness wherein edge surfaces of the cut glass sheets that extended in straight line elements from a sharp corner at an upper major surface to a sharp corner at a lower major surface were converted into rounded edge surfaces extending convexly between the major surfaces and having a radius of curvature of 0.47 cm to 0.63 cm. The glass sheets had a nominal thickness of 6 mm. The edging apparatus was capable of applying a force against the glass edge of 175 to 225 pounds (80 to 102 kg). The glass was moved past the rotating edging wheel at a speed from 1.5 to 3 inches per second (0.6 to 1.2 cm per second). The glass removed from the edge ranged from 0.35 to 0.5 grams per inch of length (0.13 to 0.20 grams per cm). Under the above conditions, wheels having diamonds of the MBG II type in a concentration of 40 removed 166,000 grams during the lifetime of the wheel. The wheel had to be stoned to renew the presence of diamond at the edging wheel surface every 20 minutes. The usual time the wheel could be run before needing to reshape the radius of the wheel was 24 hours. In an effort to improve the wheel life, diamond wheels having MBG II type diamonds in a concentration of 30 and operating under the same production conditions as the initial edge grinding wheels were tested. The second type of edge grinding wheel required stoning every 60 minutes. However, the edging wheel had to be re-radiused every 12 hours. No records were kept on the total amount of grams of glass removed with the modified MBG II wheel. When an edge grinding operation was performed using an edge grinding wheel provided with diamonds of D-mesh of the same size as the previous wheels but with blocky diamonds in a concentration of 20, the wheel could remain in operation for as long as 8 hours before requiring stoning and 48 hours between re-radiusing or shaping of the edge of the wheel. The life of the last type of edge grinding wheel, which produced an edge grinding method according to the present invention, was such that without changing the rate of speed of the glass past the diamond wheel or the force of the glass onto the wheel, or the rate of stock removal per linear distance along the periphery of the glass, that the diamond wheel performing the edge grinding method according to the present invention removed an average of 371,000 grams of glass compared to only 166,000 grams for the MBG II variety having a higher concentration.

From the results of the experiments just described, it was concluded that glass edges can be seamed more efficiently with edge grinding wheels having a low concentration of diamonds having a blocky shape than with wheels having elongated diamonds. The edges produced using the wheels provided with blocky diamonds were smooth and round. The blocky diamonds caused the wheels to require much less stoning and reshaping than the type of diamonds used previously.

The edge grinding wheels of the present invention can also be used to develop a so-called bevel edge in glass sheets. In a bevel edge, one of the sharp corners of approximately 90 degrees between the edge surface and one major surface is changed to an obtuse angle, say approximately 120 degrees, and the other sharp corner is converted to a rounded corner of convex configuration. The thickness of the perimeter edge surface of the edge grinding wheel has a bevelled edge portion that merges into a concavely rounded edge portion. An edge grinding wheel so shaped develops a shaped edge surface that merges from a tapered or sloped portion to a convexly shaped portion.

The description of the invention shown and described in the foregoing application represents an illustrative preferred embodment thereof. It is understood that various changes may be made without departing from the gist of the invention as defined in the claimed subject matter that follows.

What is claimed is:

1. An edge grinding wheel for shaping an edge of a glass sheet, comprising:

a plurality of blocky diamonds having XYZ coordinates in an approximate ratio of 1 to 1 to 1; and an adhesive to secure said blocky diamonds at the surface of said ginding wheel to provide a grinding surface with a blocky diamond concentration not to exceed approximately 15 carats per cubic inch.

2. The grinding wheel as in claim 1, wherein said edge grinding wheel includes a periphery of concavely curved contour to impart a conversely curved contour to the edge surface of said glass sheets during said edge grinding.

3. The grinding wheel as in claim 1, wherein said edge grinding wheel includes a periphery that has a beveled portion merging into a concavely curved portion to impart a contour comprising a beveled portion forming an obtuse angle with one major surface of said glass sheets merging into a convexly shaped portion merging into its other major surface.

* * * * *